US011115749B2

(12) United States Patent
Perkmann et al.

(10) Patent No.: US 11,115,749 B2
(45) Date of Patent: Sep. 7, 2021

(54) IN-EAR ACTIVE NOISE-CANCELLING EARPHONE

(71) Applicant: AUSTRIAN AUDIO GmbH, Vienna (AT)

(72) Inventors: Michael Perkmann, Vienna (AT); Daniel Wöhrer, Gablitz (AT)

(73) Assignee: AUSTRIAN AUDIO GMBH

( * ) Notice: Subject to any disclaimer, the term of this patent is extended or adjusted under 35 U.S.C. 154(b) by 0 days.

(21) Appl. No.: 16/535,486

(22) Filed: Aug. 8, 2019

(65) Prior Publication Data

US 2020/0084535 A1 Mar. 12, 2020

(30) Foreign Application Priority Data

Sep. 7, 2018 (EP) ..... 18193193
Jun. 7, 2019 (AT) ..... A 50518/2019

(51) Int. Cl.
*H04R 1/10* (2006.01)
*H04R 1/02* (2006.01)
*G10K 11/16* (2006.01)

(52) U.S. Cl.
CPC ..... *H04R 1/1083* (2013.01); *G10K 11/16* (2013.01); *H04R 1/02* (2013.01); *H04R 1/1016* (2013.01)

(58) Field of Classification Search
CPC ... H04R 1/02; H04R 1/08; H04R 1/10; H04R 1/1016; H04R 1/1058; H04R 1/1075; H04R 1/1083; H04R 1/1091; H04R 1/28; H04R 1/2803; H04R 1/2823; H04R 1/2826; H04R 1/2846; H04R 1/2849; H04R 1/2869; H04R 1/2892; H04R 1/34; H04R 25/60; H04R 25/65; H04R 25/456; H04R 25/652; G10K 11/16
See application file for complete search history.

(56) References Cited

U.S. PATENT DOCUMENTS 9,894,452 B1 2/2018 Termeulen et al.
2008/0298624 A1* 12/2008 Jeong ..... H04R 1/1091 381/380
2009/0080670 A1* 3/2009 Solbeck ..... H04R 25/453 381/71.6
2010/0316225 A1* 12/2010 Saito ..... H04R 1/1083 381/56
2011/0007907 A1 1/2011 Park et al.
(Continued)

FOREIGN PATENT DOCUMENTS

EP 3001695 A1 3/2016

OTHER PUBLICATIONS

U.S. Patent and Trademark Office, Non-Final Office Action in U.S. Appl. No. 16/541,051, dated Feb. 20, 2020, 20 pages.

*Primary Examiner* — Thang V Tran
(74) *Attorney, Agent, or Firm* — Raven Patents, LLC

(57) ABSTRACT

In-ear active noise-cancelling (ANC) earphones for which the ANC circuit remains stable even under varying wearing conditions, the earphones being worn so that an eartip of the earphone is at least partially in the external auditory canal, with at least one speaker with a frontal volume leading to a tip area and/or speaker channel, and with at least one ANC microphone. To ensure that the ANC circuit remains stable even with a small available space, the earphones feature the connection of a frontal volume and/or a speaker channel with an additional volume via a tube ending in the tip area.

11 Claims, 5 Drawing Sheets

(56) References Cited

U.S. PATENT DOCUMENTS

| | | | | |
|---|---|---|---|---|
| 2011/0064238 | A1* | 3/2011 | Haas | H04R 1/2807 381/71.6 |
| 2012/0070022 | A1* | 3/2012 | Saiki | H04R 9/063 381/312 |
| 2013/0315415 | A1* | 11/2013 | Shin | H04R 1/08 381/74 |
| 2013/0343564 | A1* | 12/2013 | Darlington | H04R 1/1016 381/74 |
| 2014/0226832 | A1* | 8/2014 | Shimizu | H04R 1/1016 381/74 |
| 2015/0023542 | A1* | 1/2015 | Shimizu | H04R 1/1075 381/380 |
| 2016/0142806 | A1* | 5/2016 | Lee | H04R 1/1075 381/375 |
| 2016/0330546 | A1 | 11/2016 | Barrentine et al. | |
| 2018/0020281 | A1* | 1/2018 | Wurtz | G10K 11/17881 |
| 2020/0058287 | A1 | 2/2020 | Pinter | |

* cited by examiner

IN-EAR ACTIVE NOISE-CANCELLING EARPHONE

TECHNICAL FIELD

The invention relates to an in-ear active noise-cancelling (ANC) earphone, which is at least partially worn in the external auditory canal, and which, when leaking, is prone to the least possible amount of quality reduction, according to the preamble of claim 1.

BACKGROUND

Several approaches to achieve this goal are known in the prior art. Reference is made to EP 2 856 771, which requires that the passage acoustically coupling the acoustic driver and the auditory canal has an open cross-sectional area of at least 10 $mm^2$ and that from the exit of this passage, called a nozzle, certain impedance limits at various frequencies are maintained. It is further disclosed therein that the axis of the acoustic driver and the center line of the passage define an angle which is greater than 30°.

Furthermore, U.S. Pat. No. 9,082,388 B requires that the nominal diameter of the transducer is greater than 10 mm. This document is part of the same patent family as the one mentioned above, but attaches importance to another focus.

EP 1 398 991 discloses a conventional ANC headphone with earpieces worn over the ears, requiring that the interior volume and the exterior volume of the earpiece communicate with each other via an acoustic resistance, and providing within the earpiece, separated by the driver and its membrane, a front cavity facing the ear and a rear cavity on the side facing away from the ear of the user wherein the front cavity has a much larger volume than the rear cavity.

U.S. Pat. No. 7,995,782 discloses in an in-ear hearing device in addition to the microphone and its acoustic channel the provision of a second channel connecting, when the hearing device is inserted, the auditory canal of the ear to the outside (the environment) in order to prevent the so-called "occlusion effect".

Further in-ear ANC headphones are disclosed in US 2009/0080670, EP 2 768 239, GB 2 526 945, and US 2014/0294182, the last two documents forming part of the same patent family but putting forward differing aspects. All of these four documents disclose tubes extending from the tip, i.e. the ear-side or "inner" end of the in-ear earphone, into the area of the device located outside the ear canal and there extending to a microphone used for the provision of data or reference data for the ANC procedure.

The content of the following documents is incorporated by reference into the content of the present application for all jurisdictions in which this is possible:

| | |
|---|---|
| EP 2 856 771 | US 2009/0080670 |
| U.S. Pat. No. 9,082,388 B | EP 2 768 239 |
| EP 1 398 991 | GB 2 526 945 |
| U.S. Pat. No. 7,995,782 | US 2014/0294182 |

SUMMARY

In-ear ANC earphones are, as previously mentioned, to be interpreted for different cases, in particular:

If the earphone leaks when worn against the ear canal, thus causing a leak, the result is a bass drop up to the critical frequency of the leak opening.

When used by different wearers, the differing geometries of the ear canals and thus the varying coupled ear volumes result in varying loads on the transducer, changing the critical frequency of the pressure chamber.

In many cases, the earphone is removed from the ear when it is still in operation and is thus operated in an open sound field. Since the earphone is not designed for this type of operation but for closed-volume operation, the secondary path frequency response (corresponding to the transfer function between speaker and microphone) is characterized by a large bass drop. The situation once again approaches that of the secondary path in the closed volume, but only for higher frequencies, where earphone output begins to act inductively.

The object and goal of the invention is to appropriately solve these problems, and to provide for an in-Ear ANC earphone in which the ANC circuit remains stable even under varying wearing conditions, with the small available space having to be taken into consideration.

According to the invention, this is accomplished by the features stated in the characterizing part of claim 1; in other words, the acoustic channel of the speaker, possibly the speaker itself as well, and a connecting acoustic channel (tube) are positioned adjacent to each other in the tip part to be inserted into the ear, the side of the speaker facing away from the ear is connected to the environment by means of a connecting opening; however, the connecting acoustic channel does not lead to the outside, but instead to an additional volume preferably arranged at a distance from the output in the vicinity of the speaker and possibly around the speaker. In the earphone as well as in the tip part, the additional channel and the speaker channel are to be routed next to each other for geometric reasons, preferably mutually sound-insulated. The task of the tip part is to connect both channels with the earphone, preferably sealed.

These measures result in the influence of unequal frontal volumes with different wearers being largely eliminated or at least markedly reduced as the additional volume relativizes these differences. Since non-sealed wearing de facto equals a change in the frontal volume (ear volume), a tendency reducing the impact occurs here as well. In addition, it is advantageously possible to provide the ANC microphone not in the area of the output of the earphone (eartip end) but in the additional volume, where there is sufficient space, thus increasing the mechanical robustness and providing for a low-pass characteristic, improving the operational stability of the ANC system.

Through the measures according to the invention, a linearization of the secondary path in terms of wearing situation is de facto achieved; furthermore, through the measures according to the invention concerning the second channel, the connecting channel, stabilization for high frequencies above about 1 kHz was achieved for the predictable acoustic friction and the additional volume, since frequency components over 1 kHz in the secondary path generally affect stability, which is suppressed by the acoustic low-pass effect.

If the earphone output is blocked in front of the speaker, as in the case of conventional designs with small volumes, the resulting sound level and the effective range of the resulting pressure chamber increase in the now smaller frontal volume. In the case of an ANC system, this condition usually leads to instabilities that manifest through acoustic overmodulation. In one embodiment of the invention, the second tube can be designed to protect against deliberate blocking of the earphone output, so that in case of such a blockage the feedback loop is interrupted so that no instability can occur in this extreme case.

BRIEF DESCRIPTION OF THE DRAWINGS

The invention is explained in more detail below with reference to the drawing, showing.

DETAILED DESCRIPTION

Figure 1:
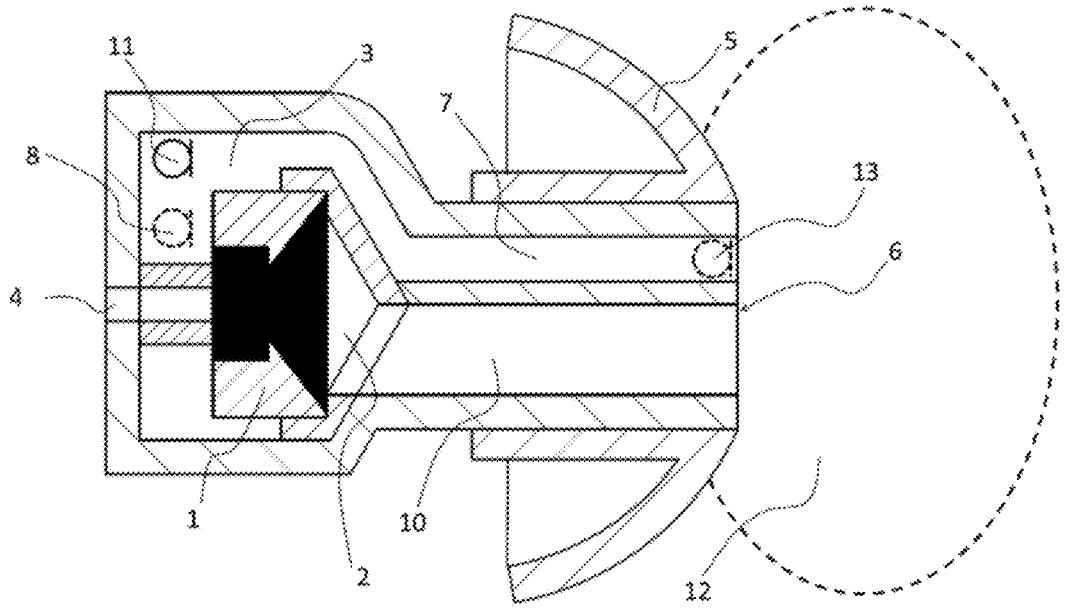
FIG. 1, a purely schematic cross-section view of an in-ear ANC earphone according to the invention, FIG. 2, examples of the frequency response change with or without additional volume according to the invention, FIG. 3, a representation according to FIG. 2, with the microphone additionally positioned in the additional volume.

FIG. 1 purely schematically illustrates an in-ear earphone according to the invention, hereinafter often only referred to as "earphone". In this case, a speaker 1 in the outer part of the earphone is acoustically connected to eartip 5 by means of a frontal volume 2 and a speaker channel 10, largely arranged in the tip part. On its reverse side it is connected to the environment via vent 4. According to the invention, a tube 7 extends from tip area 6 past speaker channel 10 and frontal volume 2, optionally also past speaker 1, to additional volume 3 occupying a noticeable to large part of the earphone. Thus, through coupling to additional volume 3 via tube 7, frontal volume 12 is significantly increased as compared to the prior art, resulting in the above-mentioned advantages of the invention. A horizontal route of the tube is assumed as intended orientation. Coupled volume 12 (FIGS. 2 and 4), corresponding to the ear volume of the user when used as intended, is schematically shown in FIG. 1 using dashed lines.

In FIG. 1, tube 7 is simply shown as empty space, which may be employed just as much as the use of a "real" tube, which by no means must have a circular cross-section. In the case of a "real" tube, the geometric situation at the transition from tube 7 to additional volume 3 would differ from the illustration of FIG. 1. In any case, it is advantageous if tube 7 is preferably sound-insulated with respect to speaker channel 10, frontal volume 2, and speaker 1.

In the prior art, microphone 11 of the ANC circuit is usually arranged in the area of eartip 5 in tip area 6 or in standard frontal volume 2. In one embodiment of the invention, microphone 11 is now arranged in the inner area of additional volume 3, for example at inner position 8, leading to surprisingly favorable results. This measure achieves results as if the microphone were arranged in the tip area, for example at virtual position 13.

Figure 2:
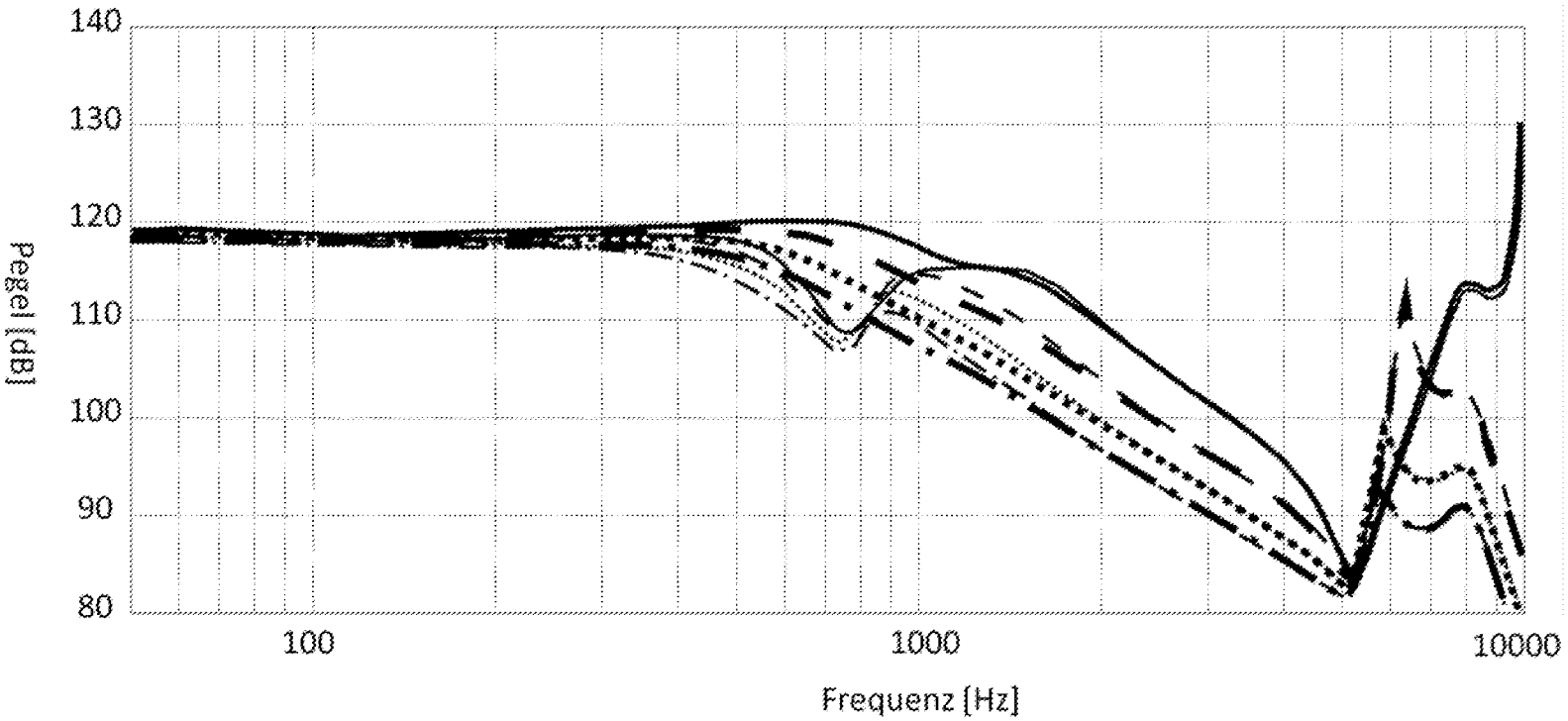

For this purpose, reference is made to FIG. 2, illustrating the changes in the secondary path in an earphone according to FIG. 1 with microphone 11 schematically at the position of tip area 6 according to the prior art in the area of eartip 5. In this case, the resulting Helmholtz resonator, which results from tube 7 with additional volume 3, appears at the thin characteristic curves in the range of 400-1000 Hz.

The illustration showing (for simplicity, the reference numerals signify the term):

Continuous line, bold: a small frontal volume 2, without coupling volume 12 (blocked), Continuous line, thin: a large frontal volume 2+3, without coupling volume 12 (blocked), Dashed line, bold: a small frontal volume 2 attached to a small coupling volume 12 (1 $cm^3$), Dashed line, thin: a large frontal volume 2+3 attached to a small coupling volume 12 (1 $cm^3$), Dotted line, bold: a small frontal volume 2 attached to an average coupling volume 12 (2 $cm^3$), Dotted line, thin: a large frontal volume 2+3 attached to an average coupling volume 12 (2 $cm^3$), Dashed-dotted line, bold: a small frontal volume 2 attached to a large coupling volume 12 (3 $cm^3$), and Dashed-dotted line, thin: a large frontal volume 2+3 attached to a large coupling volume 12 (3 $cm^3$).

It can clearly be seen that the thin lines, representing versions with additional volume 3 according to the invention, take a favorable course.

Figure 3:
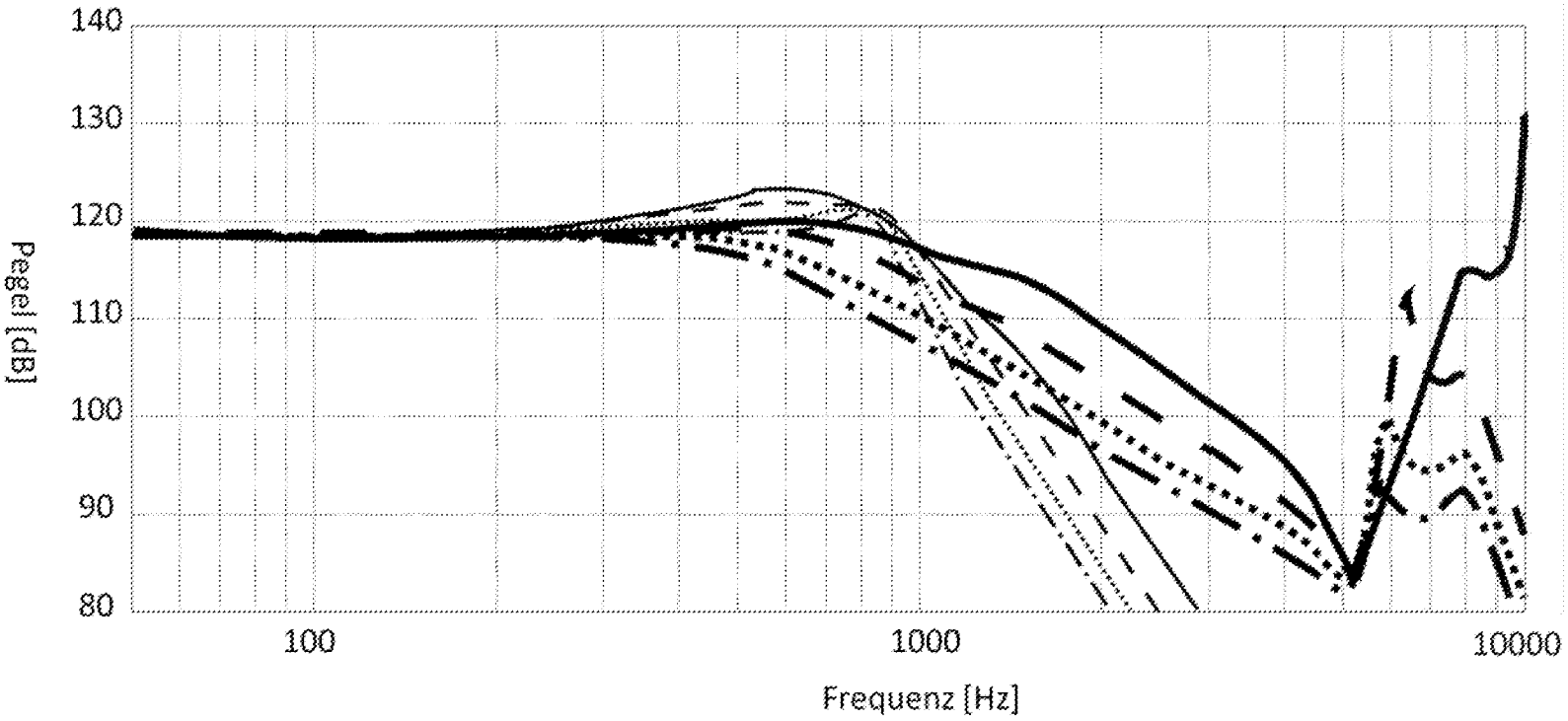

FIG. 3 shows the situation of FIG. 2 with the difference that in this case, microphone 11 is schematically positioned in additional volume 3 at an inner position 8. The description of the lines is the same as that of FIG. 2. Here, the abrupt improvement as compared to the basis of the invention shown in FIG. 2, which occurs completely unexpectedly, is also recognizable.

Figure 4:
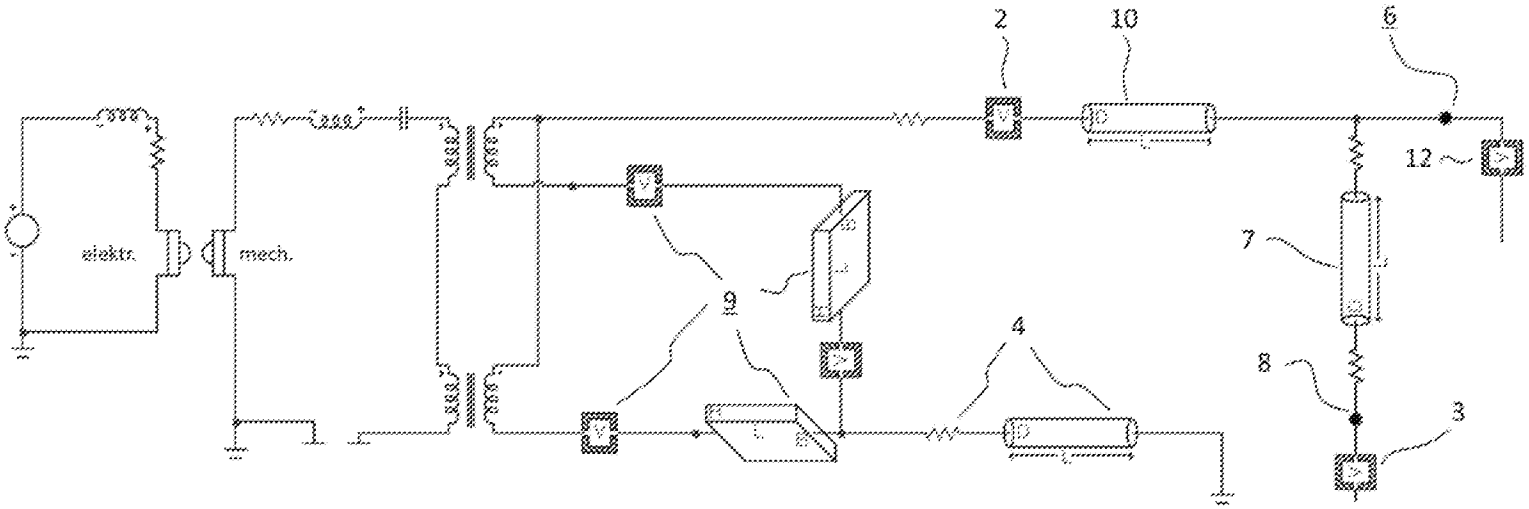
FIG. 4, an equivalent circuit diagram.

FIG. 4 shows the equivalent circuit diagram, the reference numerals shown corresponding to those of FIG. 1.

Figure 5:
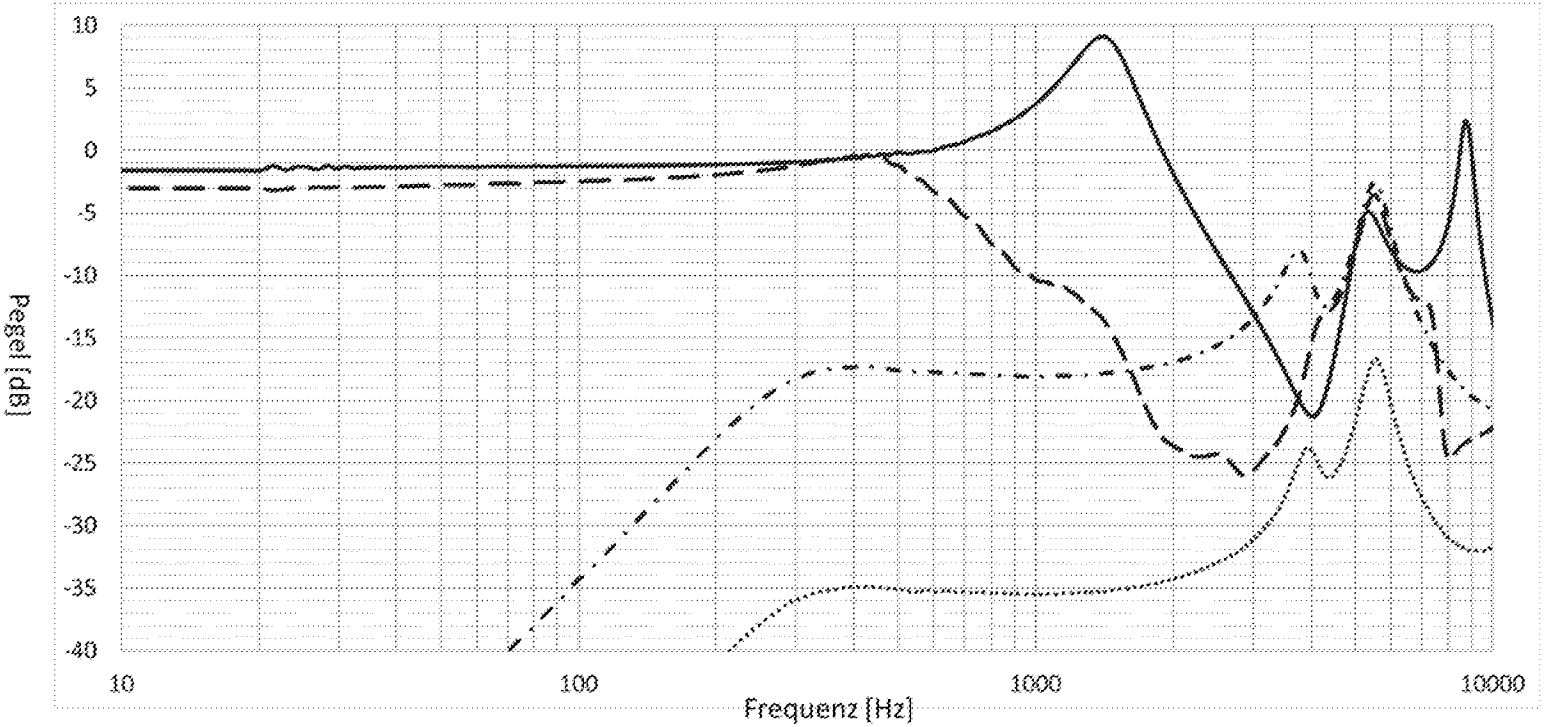
FIG. 5, frequency response for different situations for comparison.

Finally, FIG. 5 shows the frequency response for the following situations: This illustration shows the secondary path differences between the construction with/without connecting microphone 11 at inner position 8 via tube 7. In other words: standard setup vs. setup with tubes, always with the same earphone volumes 3+2.

The solid line shows the secondary path WITHOUT channel/tube for position inner area 8 of microphone 11, but direct connection to the lateral volume in which ANC microphone 11 is positioned, for the blocked case (output from earphone is blocked).

For this situation (WITHOUT channel/tube), the dashed line shows the secondary path for the wearing situation in the ear.

The dashed-dotted line shows the secondary path WITHOUT channel/tube for position inner area 8 of microphone 11, but the direct connection to the lateral volume in which ANC microphone 11 is positioned. In this case, the earphone plays in an "open" manner, i.e. it is neither worn nor blocked.

The dotted line shows the analogous situation to the dashed-dotted line, but with the significant difference that in this case the coupling according to the invention of microphone 11 (position inner area 8) positioned in additional volume 3 is implemented by means of tube 7. As a result, the position of the microphone is virtually shifted to the ear-side end of tube 7 (generally corresponding to tip area 6, depending on the design), of course with an upstream acoustic low-pass filter, which is of a mechanoacoustic nature. This virtual position in tip area 6 has the great advantage of generating additional level spacing for the ANC system for the open case. In the present case, the additional level spacing is e.g. 16 dB in the range of 300-2000 Hz.

Figure 6:
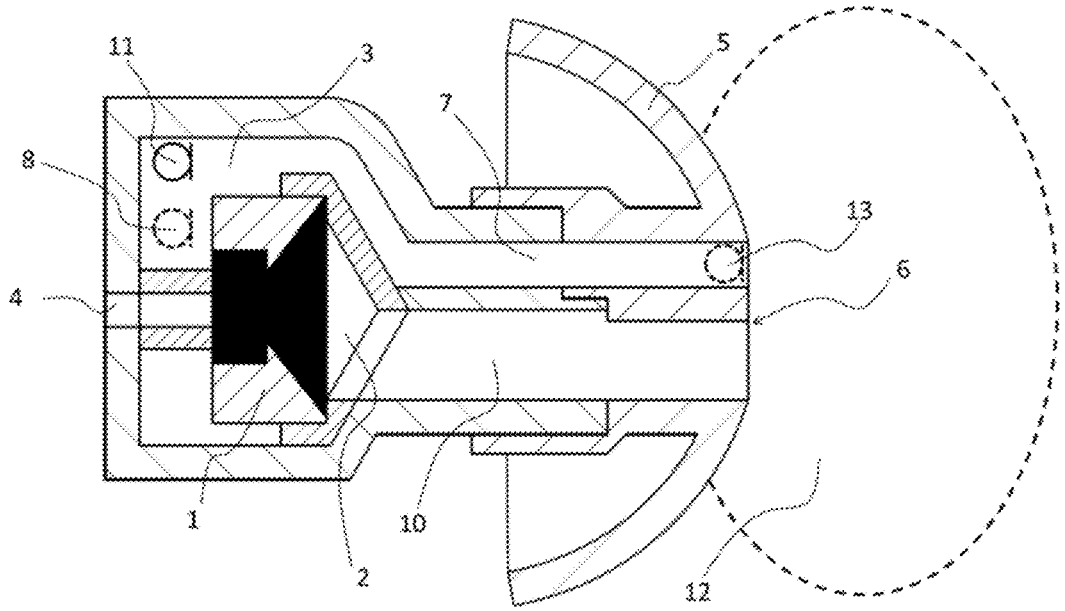
FIG. 6, a first variant in a view similar to that of FIG. 1.

FIG. 6 purely schematically illustrates an in-ear earphone according to the invention and according to FIG. 1, in which tube 7, however, does not continue from a continuous part but, subdivided by two segments, in this particular case earphone housing and sound channels (tube or channels), continues to tip area 6 as part of eartips 5.

In the illustrated and described embodiment, the speaker is provided in an outer part of the earphone; progressive miniaturization already allows for bringing this into the area of the external auditory canal. The features according to the invention are to be used advantageously in this case as well, and in the knowledge of the invention, a person skilled in the art may readily do so.

A brief description of some of the terms used in the specification and claims follows, though most will be clear to those skilled in the art:

Frontal Volume 2 is the volume located front of speaker 1 in the direction of sound propagation (standard frontal volume 2 and speaker channel 10), with the respective ear volume of the user (coupling volume 12) and, depending on the design of the earphone, with or without additional volume 3 and tube 7 for coupling additional volume 3.

Tip Area 6 is, in general, the area at the ear end of the earphone (=output) (earphone housing including eartip 5), including in tip area 6 an additional 25% of the distance from the physical end (output) of the earphone to the membrane of speaker 1.

In FIG. 1, the position Inner Area 8 is only indicated in principle; it may be located anywhere within additional volume 3 which begins at the tip-distal end of tube 7. In this case, "in the inner area" or "in the additional volume" of course denotes a wall of or wall within the additional volume in which or to which microphone 11 is mounted.

Additional Volume 3 provided according to the invention can occupy any area of the earphone without any particular restriction of its shape, insofar as the components housed therein allow it.

It may also be located around vent 4; in any case, it is a part of the earphone, usually a part of the outer part.

"At least partially worn in the external auditory canal" and related explanations in the description and claims apply mutatis mutandis to earphones located entirely within the auditory canal; the term "outer part" of the earphone is then analogously the "outer part" of the earphone, etc., in which speaker 1 and/or additional volume 3 are then preferably located.

Speaker Channel 10 extends from speaker 1 or, in channel form, from frontal volume 2 to the outer end of tip area 6 and is to be acoustically insulated from tube 7.

As indicated in FIG. 1, Tube 7 provided according to the invention extends from the ear-end of the earphone (output) to additional volume 3, for the aforementioned reasons, depending on the design, even at a small distance of a few millimeters thereof. It may be provided with a cross-sectional shape adapted to the interior of the earphone, which does not need to be constant over its length, neither in shape nor in area. The desired acoustic insulation with respect to the directly adjacent frontal volume 2, speaker channel 10, and speaker 1 itself is achieved, for example, by air-tight and preferably acoustically hard separation by means of suitable material thicknesses and high material densities.

Tube 7 has only two end openings, one in the tip area, the other emptying into additional volume 3, with especially the shape of the latter opening possibly adapted to the geometry in this area as well as to the design of the transition. The jacket of tube 7, which optionally projects into additional volume 3, is formed outside of this additional volume without any opening.

If the acoustically hard separation between frontal volume 2 with speaker channel 10 and tube 7 is not possible to tip area 6, eartip 5 itself may consist of two separate channel guides (or contain such), which, under the aforementioned conditions, receive the two-channel structure (tube 7 and speaker channel 10) of the earphone housing part as illustrated in FIG. 6, and continue/extend into tip area 6. Therefore, in this last-mentioned embodiment, tube 7 does not merely consist of a continuous part, but is subdivided by two or more segments, in this special case earphone housing and sound guides (tubes or channels), in or as part of eartip 5.

Speaker Vent 4 as a rule is also acoustically insulated from additional volume 3 and moreover has in most cases in its interior acoustic friction, which a person skilled in the art with knowledge of the invention and the design of the earphone can readily ascertain. However, a possible embodiment producing a highly inductive connection between speaker vent 4 and additional volume 3, i.e. effective only for very low frequency signals (<20 Hz), is useful in some cases to ensure an isobaric pressure equalization between frontal volume and the exterior.

The electronics for the operation of the speaker and the microphone are as in the prior art and, like the power supply and the wiring, need no further explanation; the same applies to the materials that may be used.

In the description and claims, the terms "front", rear", "top", "bottom", etc. are used in their common form and with reference to an item in its usual position of use. This means that for a weapon, the mouth of the barrel is in "front", the shutter is moved to the "rear" by the explosion gases, etc. For an overhead track, the direction of travel refers to the particular direction of the hanger, since the focus is the hanger and not the track(s); and transverse to it means essentially in a direction rotated by 90° and substantially horizontal.

It should also be noted that in the description and claims, terms such as "lower part" of a hanger, reactor, filter, building, or device or, more generally, an object mean the lower half and in particular the lower quarter of the total height; "forefront" means the foremost quarter and, in particular, an even smaller part; while "midrange" means the middle third of the total height (width-length). All this information carries its usual meaning, applied to the intended position of the object under consideration.

In the description and the claims, "substantially" means a deviation of up to 10% of the stated value, if this is physically possible, both downwards and upwards, otherwise only in the sensible direction; for degrees (of angle and temperature)±10° is meant.

All quantities and proportions, in particular those for delimiting the invention, as far as they do not relate to the specific examples, are to be understood with ±10% tolerance, thus, for example: 11% means: from 9.9% to 12.1%. For terms such as: "a microphone" the word "a" is not a numerical word but is to be regarded as the indefinite article or a pronoun, unless the context indicates otherwise.

The term: "combination" or "combinations" means, unless otherwise stated, all types of combinations, from two of the constituents concerned to a large number or all of such constituents; the term: "containing" may also be substituted with "consisting of".

The characteristics and variants specified in the individual embodiments and examples may be freely combined with those of the other examples and embodiments and may in particular be used to characterize the invention in the claims without necessarily entraining the other details of the respective embodiment or the respective example.

LIST OF REFERENCE NUMBERS

1: Speaker
2: Standard Frontal Volume ("Prior Art")
3: Additional Volume
4: Speaker Vent

5: Eartip
6: Tip Area
7: Tube for coupling the Additional Volume
8: Inner Area
9: Parameter Model
10: Speaker Channel
11: Microphone
12: Coupling Volume, Frontal Volume
13: Virtual Position

What is claimed is:

1. An active noise-cancelling earphone having an ear end and an opposing outer part, comprising:

an eartip at the ear end of the earphone that is configured to be worn at least partially within an external auditory canal, the eartip including a tip area at an ear end of the eartip;

a speaker;

a frontal volume adjacent to the speaker in a direction of sound propagation, where the frontal volume couples to the tip area, or the frontal volume couples to a speaker channel that in turn couples to the tip area;

a microphone of an active noise cancelling circuit that is configured to output to the speaker, and a tube having exactly two end openings, the tube leading from a first end opening in the tip area to a second end opening that opens to an additional volume defined within the outermost portion of the outer part of the earphone;

wherein a vent in the outer part of the earphone connects the speaker with an environment of the earphone; and the additional volume at least partially surrounds the vent.

2. The active noise-cancelling earphone according to claim 1, wherein the tube is defined by a tube jacket that is acoustically insulated along its surface with respect to one or both of the frontal volume and the speaker channel when it is adjacent to the tube.

3. The active noise-cancelling earphone according to claim 1, wherein the microphone is disposed within the additional volume defined within the earphone.

4. The active noise-cancelling earphone according to claim 1, wherein the speaker is arranged in the outer part of the earphone, and the additional volume at least partially surrounds the speaker.

5. An in-ear active noise-cancelling earphone, comprising:

an inner eartip configured to be worn at least partially within an external auditory canal;

an outer earphone portion coupled to the inner eartip;

an active noise-cancelling circuit contained within the outer earphone portion that includes an input microphone and an output speaker;

an additional volume defined within the outermost part of the outer earphone portion that at least partially surrounds the output speaker;

a frontal speaker volume adjacent to and on the inner side of the output speaker, the frontal speaker volume being acoustically coupled to a first aperture defined by the inner eartip; and a tube connecting the additional volume to a second aperture defined by the inner eartip:

wherein a vent in the outer earphone portion connects the output speaker with an environment of the earphone; and the additional volume at least partially surrounds the vent.

6. The in-ear active noise-cancelling earphone of claim 5, where the frontal speaker volume is acoustically coupled to the first aperture by a speaker channel.

7. The in-ear active noise-cancelling earphone of claim 5, where the tube connecting the additional volume to the second aperture is acoustically insulated from one or both of the frontal speaker volume and the speaker channel.

8. The in-ear active noise-cancelling earphone of claim 5, where at least an innermost portion of the speaker channel and/or the tube connecting the additional volume to the second aperture is defined by the inner eartip.

9. The in-ear active noise-cancelling earphone of claim 5, where the input microphone of the active noise-cancelling circuit is located within the additional volume within the outer earphone portion.

10. An in-ear active noise-cancelling earphone, comprising:

an inner eartip configured to be worn at least partially within an external auditory canal;

an outer earphone portion coupled to the inner eartip;

an active noise-cancelling circuit contained within the outer earphone portion that includes an input microphone and an output speaker;

an additional volume defined within the outer earphone portion; wherein at least a portion of the additional volume extends further from the inner eartip than the output speaker;

a frontal speaker volume adjacent to and on the inner side of the output speaker, the frontal speaker volume being acoustically coupled to a first aperture defined by the inner eartip; and a tube connecting the additional volume to a second aperture defined by the inner eartip:

wherein a vent in the outer earphone portion connects the output speaker with an environment of the earphone; and the additional volume at least partially surrounds the vent.

11. The in-ear active-noise-cancelling earphone of claim 10, wherein the additional volume at least partially surrounds the output speaker.

* * * * *